US008557354B2

(12) United States Patent
Simpson et al.

(10) Patent No.: US 8,557,354 B2
(45) Date of Patent: Oct. 15, 2013

(54) TRANSPARENT INK-JET RECORDING FILMS, COMPOSITIONS, AND METHODS

(76) Inventors: Sharon M. Simpson, Lake Elmo, MN (US); John D. Szafraniec, Bloomington, MN (US); James B. Philip, Jr., Mahtomed, MN (US)

( * ) Notice: Subject to any disclaimer, the term of this patent is extended or adjusted under 35 U.S.C. 154(b) by 0 days.

(21) Appl. No.: 13/208,379

(22) Filed: Aug. 12, 2011

(65) Prior Publication Data

US 2012/0045595 A1 Feb. 23, 2012

Related U.S. Application Data

(60) Provisional application No. 61/375,325, filed on Aug. 20, 2010.

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/52* (2013.01); *B41M 5/5254* (2013.01); *B41M 5/506* (2013.01); *B41M 5/5218* (2013.01)

USPC ..... 428/32.13; 428/32.24; 428/32.25; 428/32.26; 428/32.27; 428/32.28; 428/32.34

(58) Field of Classification Search

USPC ..... 428/32.13, 32.24, 32.25, 32.26, 32.27, 428/32.28, 32.34

See application file for complete search history.

(56) References Cited

U.S. PATENT DOCUMENTS

| | | | | |
|---|---|---|---|---|
| 4,365,423 | A | 12/1982 | Arter et al. | |
| 5,795,708 | A | 8/1998 | Boutet | |
| 6,387,473 | B1 * | 5/2002 | Sismondi et al. | 428/32.34 |
| 6,630,283 | B1 | 10/2003 | Simpson et al. | |
| 2001/0014381 | A1 * | 8/2001 | Kaneko et al. | 428/195 |
| 2007/0231510 | A1 * | 10/2007 | Baker | 428/32.28 |
| 2008/0057232 | A1 * | 3/2008 | Leon et al. | 428/32.24 |

FOREIGN PATENT DOCUMENTS

| | | |
|---|---|---|
| EP | 1 080 935 | 3/2001 |
| EP | 1 080 936 | 3/2001 |
| EP | 1 288 007 | 3/2003 |
| JP | 2001-191641 | 7/2001 |
| JP | 2003-326842 | 11/2003 |
| JP | 2004-243601 | 9/2004 |
| WO | WO 2008/075041 | 6/2008 |

OTHER PUBLICATIONS

*Research Disclosure*, No. 308119, Dec. 1989, pp. 46, (available from Research Disclosure, 145 Main St., Ossining, NY, 10562.

Commonly assigned U.S. Appl. No. 13/176,788, entitled: Transparent Ink-Jet Recording Film, by Simpson et al., filed Jul. 6, 2011.

International Search Report, dated Sep. 19, 2011, for International Application No. PCT/US2011/047706, 3 pages.

* cited by examiner

*Primary Examiner* — Betelhem Shewareged
(74) *Attorney, Agent, or Firm* — Reed L. Christiansen

(57) ABSTRACT

Transparent ink-jet recording films, compositions, and methods are disclosed. Such films exhibit improved ink-drying and smudging performance. These films exhibit high maximum optical densities and have low haze values. These films are useful for medical imaging.

7 Claims, No Drawings

TRANSPARENT INK-JET RECORDING FILMS, COMPOSITIONS, AND METHODS

CROSS REFERENCE TO RELATED APPLICATIONS

This application claims the benefit of U.S. Provisional Application Ser. No. 61/375,325, filed Aug. 20, 2010, entitled SMUDGE-RESISTANCE OF MATTE BLACK INKS AND DRYING OF INKS USING A 2-LAYER INKJET RECEPTOR CONTAINING A MONOSACCHARIDE OR DISACCHARIDE ON A TRANSPARENT SUPPORT, which is hereby incorporated by reference in its entirety.

SUMMARY

At least some embodiments provide transparent ink-jet recording films comprising a transparent support, at least one under-layer comprising at least one first polymer and at least one borate or borate derivative, and at least one image-receiving layer disposed on the at least one under-layer, where the at least one image-receiving layer comprises at least one second polymer and at least one inorganic particle, and where the at least one second polymer comprises at least one water soluble or water dispersible polymer cross-linkable polymer comprising at least one hydroxyl group, and where the at least one under-layer or the at least one image-receiving layer comprises at least one monosaccharide or disaccharide in an about of at least about 1.5 wt % when in the at least one under-layer or of at least about 0.89 wt % when in the at least one image-receiving layer.

The first polymer may, in some cases, comprise at least one water soluble or water dispersible cross-linkable polymer comprising at least one hydroxyl group, such as, for example, poly(vinyl alcohol). Or the first polymer may, in some cases, comprise gelatin.

The at least one monosaccharide or disaccharide may, in some cases, comprise at least one of sucrose, galactose, or lactose.

The at least one inorganic particle may, in some cases, comprise alumina.

The at least one image-receiving layer may, in some cases, comprise nitric acid.

In at least some embodiments, the at least one image-receiving layer may comprise at least about 0.89 wt %, or at least about 1.5 wt %, or at least about 1.7 wt %, or at least about 2.2 wt % of the at least one monosaccharide or disaccharide.

In at least some embodiments, the at least one image-receiving layer may comprise less than about 4.3 wt %, or less than about 2.2 wt %, of the at least one monosaccharide or disaccharide.

In some cases, at least one of the at least one under-layer or the at least one image-receiving layer may further comprise nonyl phenol, glycidyl polyether.

Another embodiment provides a transparent ink-jet recording film comprising a transparent support, at least one under-layer comprising poly(vinyl alcohol) and at least one borate or borate derivative, and at least one image-receiving layer disposed on the at least one under-layer, where the at least one image-receiving layer comprises alumina, poly(vinyl alcohol), nitric acid, and at least one monosaccharide or disaccharide in an amount of at least about 0.89 wt %.

Yet another embodiment provides a transparent ink-jet recording film comprising a transparent support, at least one under-layer comprising gelatin and at least one borate or borate derivative, and at least one image-receiving layer disposed on the at least one under-layer, where the at least one image-receiving layer comprises alumina, poly(vinyl alcohol), nitric acid, and at least one monosaccharide or disaccharide in an amount between about 0.89 wt % and about 4.3 wt %.

These embodiments and other variations and modifications may be better understood from the detailed description, exemplary embodiments, examples, and claims that follow. Any embodiments provided are given only by way of illustrative example. Other desirable objectives and advantages inherently achieved may occur or become apparent to those skilled in the art. The invention is defined by the appended claims.

DETAILED DESCRIPTION

All publications, patents, and patent documents referred to in this document are incorporated by reference herein in their entirety, as though individually incorporated by reference.

U.S. Provisional Application No. 61/375,325, filed Aug. 20, 2010, is hereby incorporated by reference in its entirety.

DEFINITIONS

As used herein:

The terms "a" or "an" refer to "at least one" of that component (for example, the ink-jet inks, polymers, and surfactants described herein). Thus the term "an ink-receptive coating can refer to a coating capable of receiving one or more inks.

The terms "under-layer" or "buried layer" indicate that there is at least one other layer disposed over the layer (such as a "buried" "under-layer").

The terms "image-receiving layer" or "topcoat layer" refer to a layer that is coated over the under-layer. Often the image-receiving layer is the outermost layer and serves as the layer that absorbs the ink-jet inks.

The terms "coating weight", "coat weight", and "coverage" are synonymous, and are usually expressed in weight or moles per unit area such as $g/m^2$ or $mol/m^2$.

Unless otherwise indicated, when the terms "ink-jet recording film," "ink-jet recording material," "ink-jet recording element" or ink-jet recording article" are used herein, the terms refer to embodiments of the present invention.

The term "transparent" means capable of transmitting visible light without appreciable scattering or absorption.

The term "article" refers to a construction having a coating of one or more "ink-receiving layers" on a transparent support.

The term "immediately after imaging" refers to the point at which the trailing edge of the imaged film exits the printer.

"Haze" is wide-angle scattering that diffuses light uniformly in all directions. It is the percentage of transmitted light that deviates from the incident beam by more than 2.5 degrees on the average. Haze reduces contrast and results in a milky or cloudy appearance. The lower the haze number, the less hazy the material.

The term "aqueous solvent" means water is present in the greatest proportion in a homogeneous solution as liquid component.

The term "water soluble" means the solute forms a homogenous solution with water, or a solvent mixture in which water is the major component.

"Simultaneous coating" or "wet-on-wet" coating means that when multiple layers are coated, subsequent layers are coated onto the initially coated layer before the initially coated layer is dry. Simultaneous coating can be used to apply layers on the frontside, backside, or both sides of the support.

The terms "frontside" and "backside" of the film refer to the "first and second major surfaces" respectively. In the ink-jet recording films described herein that are coated onto a transparent support, the ink-receiving coatings and under-layer coated onto the frontside (first major surface) of the support.

The terms "front" and "back" refer to layers, films, or coatings nearer to and farther from, respectively, the source of the ink-jet inks.

*Research Disclosure* No. 308119, December 1989, pp. 1007-08 is published by Kenneth Mason Publications, Ltd., The Book Barn, Westbourne, Hampshire, PO10 8RS, UK. The publication is also available from Research Disclosure, 145 Main Street, Ossining, N.Y. 10562 (www.researchdisclosure.com).

Introduction

In a typical ink-jet recording or printing system, ink droplets are ejected from a nozzle at high speed towards a recording film, element, or medium to produce an image on the film. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol, or mixtures thereof.

An ink-jet recording film typically comprises a support having on at least one surface thereof an ink-receiving or image-forming layer, and includes those intended for reflection viewing, which have an opaque support, and those intended for viewing by transmitted light, which have a transparent support.

To achieve and maintain photographic-quality images on such an image-recording film, an ink-jet recording film preferably:

Is readily wetted so there is little or no puddling, i.e., coalescence of adjacent ink dots, which leads to non-uniform density.

Exhibits little or no image bleeding.

Exhibits the ability to absorb high concentrations of ink and dry quickly to avoid films blocking together when stacked against subsequent prints or other surfaces.

Exhibits few or no discontinuities or defects due to interactions between the support and/or layer(s), such as cracking, repellencies, comb lines and the like.

Does not encourage unabsorbed dyes to aggregate at the free surface causing dye crystallization, which may result in bloom or bronzing effects in the imaged areas.

Comprises an optimized image fastness to avoid fade from contact with water or radiation by daylight, tungsten light, or fluorescent light.

Exhibits little to no smudging of the ink after printing when handled after printing.

In addition, a transparent ink-jet recording film suitable for medical imaging output preferably provides:

A transparent maximum optical density of at least about 2.8.

A grey scale sufficient to distinguish among the densities of various body structures.

A haze value at least that of current medical X-ray films (i.e., about 26 or less).

An ink-jet recording film that simultaneously provides an almost instantaneous ink dry time, little to no smudging of the inks and good image quality is desirable. However, given the wide range of ink compositions and ink volumes that an ink-jet recording film needs to accommodate, these requirements are difficult to achieve simultaneously.

Ink-jet recording films are known that employ porous or non-porous single layer or multilayer coatings that act as suitable image-receiving layers on one or both sides of a porous or non-porous support. Recording films that use non-porous coatings typically have good image quality but exhibit poor ink dry time. Recording films that use porous coatings typically contain colloidal particulates and have poorer image quality but exhibit superior dry times.

While a variety of porous image-recording films for use with ink-jet printing are known, there are unsolved problems in the art and deficiencies in known products which have limited their commercial usefulness.

A challenge in the design of a transparent porous ink-receiving layer for ink-jet films is providing high quality, crack-free coatings with as little/minimal non-particulate matter as possible. If too much non-particulate matter is present, the image-receiving layer will not be sufficiently porous and can exhibit poor ink dry times. If too much particulate matter is present, the image-receiving layer can have a high level of haze or can exhibit cracking.

An additional challenge in preparing transparent ink-jet recording films is providing images having high density. Typical ink-jet films use a reflective backing. In these films, a high density image is achieved because light is absorbed as it passes into the imaged film and again, upon reflection, as it passes out of the film. For transparent films, such as those used to record medical X-rays, the high density image is achieved by laying down a large amount of ink. However, the large amount of ink required leads to slow drying images, because of the larger amounts of liquids to be removed during drying. To compensate for the slow drying, heaters and/or slow through-put are required.

The addition of a monosaccharide such as fructose, galactose or glucose, or the addition of a disaccharide such as sucrose or lactose to the image-receiving layer can provide a quick-drying, crack-free, improved smudge-resistance transparent ink-jet recording film capable of achieving an optical density of at least 2.8, a haze of less than 26, and a large number of grey levels.

Transparent Ink-Jet Films

Transparent ink-jet recording films are known in the art. See, for example, U.S. patent application Ser. No. 13/176,788, "TRANSPARENT INK-JET RECORDING FILM," by Simpson et al., filed Jul. 6, 2011, and U.S. Provisional Patent Application No. 61/375,325, "SMUDGE RESISTANCE OF MATTE BLANK INKS AND DRYING OF INKS USING A 2-LAYER INKJET RECEPTOR CONTAINING A MONOSACCHARIDE OR DISACCHARIDE ON A TRANSPARENT SUPPORT," by Simpson et al., filed Aug. 20, 2010, both of which are hereby incorporated by reference in their entirety.

Transparent ink-jet recording films may comprise one or more transparent substrates upon which at least one under-layer may be coated. Such an under-layer may be dried before being further processed. The film may further comprise one or more image-receiving layers coated upon at least one under-layer. Such an image-receiving layer is generally dried after coating. The film may optionally further comprise additional layers, such as one or more primer layers, subbing layers, backing layers, or overcoat layers, as will be understood by one skilled in the art.

Under-Layer Coating Mix

Under-layers may be formed by applying at least one under-layer coating mix to one or more transparent substrates. Such coating mixes typically comprise a polymer, such as gelatin or a water soluble or dispersible cross-linkable polymer comprising at least one hydroxyl group, and a borate or borate derivative.

In some embodiments, the under-layer coating mix may comprise gelatin. In at least some embodiments, the gelatin may be a Regular Type IV bovine gelatin. The under-layer coating mix may further comprise at least one borate or borate derivative, such as, for example, sodium borate, sodium tetraborate, sodium tetraborate decahydrate, boric acid, phenyl boronic acid, butyl boronic acid, and the like. More than one type of borate or borate derivative may optionally be included in the under-layer coating mix. In some embodiments, the borate or borate derivative may be used in an amount of up to about 2 $g/m^2$. In at least some embodiments, the ratio of the at least one borate or borate derivative to the gelatin may be between about 20:80 and about 1:1 by weight, or the ratio may be about 0.45:1 by weight. The under-layer formed may, in some cases, comprise at least about 2.9 $g/m^2$ solids on a dry basis, or at least about 3.0 $g/m^2$ solids on a dry basis, or at least about 3.5 $g/m^2$ solids on a dry basis, or at least about 4.0 $g/m^2$ solids on a dry basis, or at least about 4.2 $g/m^2$ solids on a dry basis, or at least about 5.0 $g/m^2$ solids on a dry basis, or at least about 5.8 $g/m^2$ solids on a dry basis.

In other embodiments, the under-layer coating mix may comprise at least one water soluble or dispersible cross-linkable polymer comprising at least one hydroxyl group, such as, for example, poly(vinyl alcohol), partially hydrolyzed poly (vinyl acetate/vinyl alcohol), copolymers containing hydroxyethylmethacrylate, copolymers containing hydroxyethylacrylate, copolymers containing hydroxypropylmethacrylate, hydroxy cellulose ethers, such as, for example, hydroxyethylcellulose, and the like. More than one type of water soluble or water dispersible cross-linkable polymer may optionally be included in the under-layer coating mix. In some embodiments, the water soluble or water dispersible polymer may be used in an amount of, for example, from about 0.25 to about 2.0 $g/m^2$, or from about 0.02 to about 1.8 $g/m^2$, as measured in the under-layer. The under-layer coating mix may also optionally comprise at least one borate or borate derivative, such as, for example, sodium borate, sodium tetraborate, sodium tetraborate decahydrate, boric acid, phenyl boronic acid, butyl boronic acid, and the like. More than one type of borate or borate derivative may optionally be included in the under-layer coating mix. In some embodiments, the borate or borate derivative may be used in an amount of up to about 2 $g/m^2$. In at least some embodiments, the ratio of the at least one borate or borate derivative to the at least one water soluble or water dispersible polymer may be, for example, between about 25:75 and about 90:10 by weight, or the ratio may be about 66:33 by weight. The under-layer formed may, in some cases, comprise less than about 3 $g/m^2$ on a dry basis.

In these and other embodiments, the under-layer coating mix may comprise one or more monosaccharides, such as, for example, fructose, galactose or glucose, or disaccharides, such as, for example, sucrose or lactose. Such monosaccharides or disaccharides may, in some cases, be used in an about of at least about 1.5 wt % as measured in the at least one under-layer on a dry solids basis.

The under-layer coating mix may also optionally comprise other components, such as surfactants, such as, for example, nonyl phenol, glycidyl polyether. In some embodiments, such a surfactant may be used in amount from about 0.001 to about 0.20 $g/m^2$, as measured in the under-layer. In some embodiments, the under-layer coating mix may optionally further comprise a thickener, such as, for example, a sulfonated polystyrene. These and other optional mix components will be understood by those skilled in the art.

In some embodiments, the under-layer coating mix may comprise at least about 4 wt % solids, or at least about 9.2 wt % solids. The under-layer coating mix may comprise, for example, about 15 wt % solids.

Image-Receiving Layer Coating Mix

Image-receiving layers may be formed by applying at least one image-receiving layer coating mix to one or more under-layer coatings. The image-receiving layer formed may, in some cases, comprise at least about 40 $g/m^2$ on a dry basis, or at least about 41.0 $g/m^2$ on a dry basis, or at least about 43 $g/m^2$ on a dry basis, or at least about 44 $g/m^2$ on a dry basis, or at least about 50 $g/m^2$ on a dry basis. The image-receiving coating mix may comprise at least one water soluble or dispersible cross-linkable polymer comprising at least one hydroxyl group, such as, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, such as, for example, hydroxyethylcellulose, and the like. More than one type of water soluble or water dispersible cross-linkable polymer may optionally be included in the under-layer coating mix. In some embodiments, the at least one water soluble or water dispersible polymer may be used in an amount of up to about 1.0 to about 4.5 $g/m^2$, as measured in the image-receiving layer.

The image-receiving layer coating mix may also comprise at least one inorganic particle, such as, for example, metal oxides, hydrated metal oxides, boehmite alumina, clay, calcined clay, calcium carbonate, aluminosilicates, zeolites, barium sulfate, and the like. Non-limiting examples of inorganic particles include silica, alumina, zirconia, and titania. Other non-limiting examples of inorganic particles include fumed silica, fumed alumina, and colloidal silica. In some embodiments, fumed silica or fumed alumina have primary particle sizes up to about 50 nm in diameter, with aggregates being less than about 300 nm in diameter, for example, aggregates of about 160 nm in diameter. In some embodiments, colloidal silica or boehmite alumina have particle size less than about 15 nm in diameter, such as, for example, 14 nm in diameter. More than one type of inorganic particle may optionally be included in the image-receiving coating mix.

In at least some embodiments, the ratio of inorganic particles to polymer in the at least one image-receiving layer coating mix may be, for example, between about 88:12 and about 95:5 by weight, or between about 90:10 and about 95:5 by weight, or the ratio may be about 92:8 by weight.

Image-receiving layer coating layer mixes prepared from alumina mixes with higher solids fractions can perform well in this application. However, high solids alumina mixes can, in general, become too viscous to be processed. It has been discovered that suitable alumina mixes can be prepared at, for example, 25 wt % or 30 wt % solids, where such mixes comprise alumina, nitric acid, and water, and where such mixes comprise a pH below about 3.09, or below about 2.73, or between about 2.17 and about 2.73. During preparation, such alumina mixes may optionally be heated, for example, to 80° C.

In these and other embodiments, the under-layer coating mix may comprise one or more monosaccharides, such as, for example, fructose, galactose or glucose, or disaccharides, such as, for example, sucrose or lactose. Such monosaccharides or disaccharides may, in some cases, be used in an about of at least about 0.89 wt % as measured in the at least one image-receiving layer on a dry solids basis.

The image-receiving coating layer mix may also comprise one or more surfactants such as, for example, nonyl phenol, glycidyl polyether. In some embodiments, such a surfactant may be used in amount of, for example, about 1.5 g/m$^2$, as measured in the image-receiving layer. In some embodiments, the image-receiving coating layer mix may also optionally comprise one or more acids, such as, for example, nitric acid.

These and other components may optionally be included in the image-receiving coating layer mix, as will be understood by those skilled in the art.

Transparent Substrate

Transparent substrates may be flexible, transparent films made from polymeric materials, such as, for example, polyethylene terephthalate, polyethylene naphthalate, cellulose acetate, other cellulose esters, polyvinyl acetal, polyolefins, polycarbonates, polystyrenes, and the like. In some embodiments, polymeric materials exhibiting good dimensional stability may be used, such as, for example, polyethylene terephthalate, polyethylene naphthalate, other polyesters, or polycarbonates.

Other examples of transparent substrates are transparent, multilayer polymeric supports, such as those described in U.S. Pat. No. 6,630,283 to Simpson, et al., which is hereby incorporated by reference in its entirety. Still other examples of transparent supports are those comprising dichroic mirror layers, such as those described in U.S. Pat. No. 5,795,708 to Boutet, which is hereby incorporated by reference in its entirety.

Transparent substrates may optionally contain colorants, pigments, dyes, and the like, to provide various background colors and tones for the image. For example, a blue tinting dye is commonly used in some medical imaging applications. These and other components may be included in the transparent substrate, as will be understood by those skilled in the art.

In some embodiments, the transparent substrate is provided as a continuous or semi-continuous web, which travels past the various coating, drying, and cutting stations in a continuous or semi-continuous process.

Coating

The at least one under-layer and at least one image-receiving layer may be coated from mixes onto the transparent substrate. The various mixes may use the same or different solvents, such as, for example, water or organic solvents. Layers may be coated one at a time, or two or more layers may be coated simultaneously. For example, simultaneously with application of an under-layer coating mix to the support, an image-receiving layer may be applied to the wet under-layer using, for example, such methods as slide coating.

Layers may be coated using any suitable methods, including, for example, dip-coating, wound-wire rod coating, doctor blade coating, air knife coating, gravure roll coating, reverse-roll coating, slide coating, bead coating, extrusion coating, curtain coating, and the like. Examples of some coating methods are described in, for example, *Research Disclosure*, No. 308119, December 1989, pp. 1007-08, (available from Research Disclosure, 145 Main St., Ossining, N.Y., 10562, http://www.researchdisclosure.com).

Drying

Coated layers, such as, for example under-layers or image-receiving layers, may be dried using a variety of known methods. Examples of some drying methods are described in, for example, *Research Disclosure*, No. 308119, December 1989, pp. 1007-08, (available from Research Disclosure, 145 Main St., Ossining, N.Y., 10562, http://www.researchdisclosure-.com). In some embodiments, coating layers are dried as they travel past one or more perforated plates through which a gas, such as, for example, air or nitrogen, passes. Such an impingement air dryer is described in U.S. Pat. No. 4,365,423 to Arter et al., which is incorporated by reference in its entirety. The perforated plates in such a dryer may comprise perforations, such as, for example, holes, slots, nozzles, and the like. The flow rate of gas through the perforated plates may be indicated by the differential gas pressure across the plates. The ability of the gas to remove water will be limited by its dew point, while its ability to remove organic solvents will be limited by the amount of such solvents in the gas, as will be understood by those skilled in the art.

EXEMPLARY EMBODIMENTS

U.S. Provisional Application No. 61/375,325, filed Aug. 20, 2010, which is hereby incorporated by reference in its entirety, disclosed the following fourteen non-limiting exemplary embodiments:

A. An ink-jet recording film comprising:

a transparent support;

an under-layer comprising at least one water soluble or water dispersible cross-linkable polymer and at least one borate or borate derivative, said at least one water soluble or water dispersible cross-linkable polymer comprising at least one hydroxyl group; and an image-receiving layer disposed on the under-layer, said image-receiving layer comprising at least one water soluble or water dispersible cross-linkable polymer and at least one inorganic particle, said at least one water soluble or water dispersible cross-linkable polymer comprising at least one hydroxyl group, wherein at least one of the under-layer or the image-receiving layer further comprises at least one monosaccharide or disaccharide in an amount of at least 1.5 wt % when in the under-layer or of at least 0.89 wt % when in the image-receiving layer.

B. The ink-jet recording film according to embodiment A, wherein the at least one monosaccharide or disaccharide comprises at least one of sucrose, galactose, or lactose.

C. The ink-jet recording film according to embodiment A, wherein the at least one inorganic particle comprises alumina.

D. A method comprising:

providing the ink-jet recording film according to embodiment A; and applying ink to the ink-jet recording film with an ink-jet printer.

E. A method comprising:

coating an under-layer onto a transparent support, said under-layer comprising at least one water soluble or water dispersible cross-linkable polymer and at least one borate or borate derivative, said at least one water soluble or water dispersible cross-linkable polymer comprising at least one hydroxyl group; and coating an image-receiving layer onto the under-layer, said image-receiving layer comprising at least one water soluble or water dispersible cross-linkable polymer and at least one inorganic particle, said at least one water soluble or water dispersible cross-linkable polymer comprising at least one hydroxyl group, wherein at least one of the under-layer or the image-receiving layer further comprises at least one monosaccharide or disaccharide in an amount of at least 1.5 wt % when in the under-layer or of at least 0.89 wt % when in the image-receiving layer.

F. The method according to embodiment E, wherein the at least one monosaccharide or disaccharide comprises at least one of sucrose, galactose, or lactose.

G. The method according to embodiment E, wherein the at least one inorganic particle comprises alumina.

EXAMPLES

Materials

Materials used in the examples were available from Aldrich Chemical Co., Milwaukee, unless otherwise specified.

Boehmite is an aluminum oxide hydroxide (γ-AlO(OH)).

Borax is sodium tetraborate decahydrate.

CELVOL® 203 is a poly(vinyl alcohol) that is 87-89% hydrolyzed, with 13,000-23,000 weight-average molecular weight. It is available from Sekisui Specialty Chemicals America, LLC, Dallas, Tex.

CELVOL® 540 is a poly(vinyl alcohol) that is 87-89.9% hydrolyzed, with 140,000-186,000 weight-average molecular weight. It is available from Sekisui Specialty Chemicals America, LLC, Dallas, Tex.

DISPERAL® HP-14 is a dispersible boehmite alumina powder with high porosity and a particle size of 140 nm. It is available from Sasol North America, Inc., Houston, Tex.

Gelatin is a Regular Type IV bovine gelatin. It is available as Catalog No. 8256786 from Eastman Gelatine Corporation, Peabody, Minn.

Surfactant 10G is an aqueous solution of nonyl phenol, glycidyl polyether. It is available from Dixie Chemical Co., Houston, Tex.

Methods

Imaging of Samples

Samples were imaged with an EPSON® 7900 ink-jet printer using a Wasatch Raster Image Processor (RIP). A grey scale image was created by a combination of photo black, light black, light light black, magenta, light magenta, cyan, light cyan, and yellow EPSON® inks supplied with the ink-jet printer. Samples were printed with a 17 step grey scale wedge with a maximum optical density of at least 2.8. The percent of the patch at an optical density of at least 2.8 was evaluated less than 5 seconds after the sheet exited the printer.

Samples were also imaged with an EPSON® 4880 ink-jet printer using a Photoshop Raster Image Processor (RIP). A grey scale image was created by a combination of matte black or a matte black and a photo black EPSON® inks supplied with the ink-jet printer. Samples were printed with a 21 step grey scale wedge with a maximum Optical Density of at least 3.0 with the matte black only and 4.5 with the matte black and the photo black. The smudging of the patches at an optical density of at least 3.0 was evaluated less than 30 seconds, 6 hours and 24 hours after the sheet exited the printer.

Optical Density (OD) of each sample was measured using a calibrated X-RITE®Model DTP 41 Spectrophotometer (X-Rite Inc. Grandville, Mich.) in transmission mode.

Measurement of Drying of Ink

A sheet of film was imaged using an ink-jet printer configured to produce 17 step grey scale wedges. Immediately after the film exited the printer, the ink-jet image was turned over and held above a piece of white paper. The percent of wet ink on the step having the maximum density was graded on a scale of 0 (completely dry) to 100 (the ink on the rectangle was completely wet). It is preferred that the portion of the film having an optical density of at least 2.8 is substantially dry (i.e., has a wetness value of no more than 25%, less than 5 seconds after imaging). It is preferred that the portion of the film having a maximum density greater than about 3 has a value of at no more than 75%, less than 5 seconds after imaging.

Measurement of Smudging of Ink

Two different test methods have been used to quantify ink smudging. In a first method, a sheet of film was imaged using an ink-jet printer configured to produce 21 step grey scale wedges. Immediately after the film exited the printer, the ink-jet image was rubbed and swiped with a KIMWIPES® wiper from the maximum to minimum density wedges with 1 to 2 pounds of pressure. The amount of smudging on the step was graded on a scale of 10 (no smudging) to 0 (the ink smudged across the gray-scale wedges from maximum to minimum density). It is preferred that the portion of the film having an optical density of at least 3.0 minimally smudges or has a value of no less than 4 after 6 hours from printing with the matte black ink. It is preferred that the portion of the film having a maximum density of at least 3.0 has a smudging value of at no less than 6 after 24 hours from printing with the matte black ink.

In a second method, a sheet of film was imaged using an ink-printer configured to produce three strips of 17 step gray-scale wedges, using EPSON® 4900 matte black ink, spanning optical densities from a maximum optical density of about 2.95-3.00 (Step 17) to a minimum optical density of about 0.19 (Step 1), as measured by an X-RITE® Model DTP-361V Densitometer (X-Rite Inc. Grandville, Mich.) in transmission mode. An assembly was constructed that consisted of a 3 cm×3 cm 1600 weight positioned over a once-folded WEBRIL®HANDI-PAD pad, which in turn was positioned over a once-folded KIMWIPES° EX-L Delicate Task Wipe.

Twenty seconds after the film exited the printer, the weight/pad/wipe assembly was placed on the film, wiper-side down, over Steps 1-5 of the first strip. The assembly was pulled from Steps 1-5, across the wedges of the strip, towards Step 17. This process was repeated with a new assembly using the second strip of wedges. The third strip was left as printed, to serve as an un-smudged control. The film was then allowed to dry for 2 hours at 20° C. and 47% relative humidity.

For each trial, optical densities of Steps 10-14 (with approximate optical densities of about 1.1-2.1) were measured for each of the three strips. The values for the first and second strips were averaged and compared to the value for the third strip (un-smudged control) to obtain a percent loss of density due to smudging for each of Steps 10-14.

Measurement of Haze

Haze (%) was measured in accord with ASTM D 1003 by conventional means using a HAZE-GARD PLUS Hazemeter that is available from BYK-Gardner (Columbia, Md.). Total haze for ink-jet recording film should be as low as possible. It is desired that it not be more than 26% and preferably it should not be more than 24%. The haze value of the support is about 2.5±1%. To provide consistent haze measurements, all samples within each Example were coated onto the same lot of support.

Example 1

The following example demonstrates the use of sucrose in the image-receiving layer.

Preparation of Under-Layer

A coating solution was prepared by mixing 3.84 g of deionized water, 0.88 g of CELVOL® 203 poly(vinyl alcohol) as a 15% aqueous solution and 5.28 g of borax as a 5% aqueous solution. The ratio of borax to poly(vinyl alcohol) was 66:33 by weight. The coating solution was knife coated at room temperature onto a 7 mil (178 micron) polyethylene terephthalate support. The coating was air dried. The dry coating weight of the under-layer was 0.64 g/m$^2$.

Preparation and Evaluation of Image-Receiving Layers

A coating solution for the ink-jet, image-receiving layer (Comparative Example 1-1) was prepared by mixing 41.0 g of DISPERAL® HP-14 (pH adjusted to 3.25 with 70% nitric acid) as a 20% aqueous solution, 7.13 g of CELVOL®540 poly(vinyl alcohol) as a 10% aqueous solution, and 0.58 g of a Surfactant 10G as a 10% aqueous solution. The finished coating solution was at 18.0% solids. Inventive coating solutions, Examples 1-2, 1-3 and 1-4 were also prepared as described above but 0.40 g, 0.80 g or 1.08 g of a 20% aqueous solution of sucrose were added, respectively. The finished coating solutions were at 18.2%, 18.3%, or 18.4% solids, respectively. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The image-receiving layer was coated at 41 g/m$^2$ (using a 12.0 mil knife gap). In all, 4 samples were prepared.

Samples were imaged as described above for drying of ink or to determine the smudging of ink (first method). Table I shows the percent by weight of the disaccharide added to the coating, the fraction of the patch having an optical density of 2.9 that was still wet 5 seconds after the completion of printing, and the smudging values with matte black or matte black and photo black after 30 seconds, 6 hours and 24 hours after printing and haze.

The data demonstrates that the addition of 2.37 wt % of sucrose to the ink-jet, image-receiving layer improved the time to dry the ink patch having an optical density of at least 2.8.

The data also demonstrates that the addition of at least 0.89 wt % of sucrose to the image-receiving layer improved smudging after 6 hours from printing with the matte black or matte black and photo black inks.

TABLE I

| Sample # and Ink(s) | Sucrose (wt % of dry solids) | Percent of Patch Wet | Smudge Value at 30 sec | Smudge Value at 6 hr | Smudge Value at 24 hr | Haze (%) |
|---|---|---|---|---|---|---|
| 1-1 MB | 0 | 12.5 | 2 | 3 | 3 | 21 |
| 1-1 MB/PB | 0 | 12.5 | 3 | 6 | 7 | 21 |
| 1-2 MB | 0.89 | NM | 2 | 5 | 4 | 23 |
| 1-2 MB/PB | 0.89 | NM | 2 | 7 | 8 | 23 |
| 1-3 MB | 1.76 | 12.5 | 2 | 5 | 5 | 24 |
| 1-3 MB/PB | 1.76 | 12.5 | 4 | 9 | 9 | 24 |
| 1-4 MB | 2.37 | 0 | 2 | 5 | 5 | 23 |
| 1-4 MB/PB | 2.37 | 0 | 4 | 8 | 8 | 23 |

NOTE:
"MB" = Matte Black Ink
"MB/PB" = Matte Black and Photo Black Inks
"NM" = Not Measured Example 2

The following example demonstrates the use of sucrose in the image-receiving layer. An under-layer was prepared as described in Example 1.

Preparation and Evaluation of Image-Receiving Layers

A coating solution for the ink-jet, image-receiving layer (Comparative Example 2-1) was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, and 0.60 g of Surfactant 10G as a 10% aqueous solution. The finished coating solution was at 18.0% solids. Inventive coating solutions, Examples 2-2, 2-3 and 2-4 were also prepared as described above but 0.40 g, 0.70 g or 1.06 g of a 40% aqueous solution of sucrose were added, respectively. The finished coating solutions were at 18.3%, 18.6%, or 18.9% solids, respectively. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The image-receiving layer was coated at 41 g/m$^2$ (using a 12.0 mil knife gap). In all, 4 samples were prepared.

Samples were imaged as described above to determine the smudging of ink (first method). Table II shows the percent by weight of the disaccharide added to the coating, and the smudging values with matte black or matte black and photo black after 30 seconds, 6 hours and 24 hours after printing and haze.

The data also demonstrates that the addition of at least 1.76 wt % of sucrose to the image-receiving layer improved smudging after 6 hours from printing from printing with the matte black or matte black and photo black inks.

TABLE II

| Sample # and Ink(s) | Sucrose (wt % of dry solids) | Smudge Value at 30 sec | Smudge Value at 6 hr | Smudge Value at 24 hr | Haze (%) |
|---|---|---|---|---|---|
| 2-1 MB | 0 | 2 | 2 | 4 | 22 |
| 2-1 MB/PB | 0 | 2 | 2 | 2 | 22 |
| 2-2 MB | 1.76 | 3 | 4 | 7 | 22 |
| 2-2 MB/PB | 1.76 | 2 | 4 | 5 | 22 |
| 2-3 MB | 3.05 | 4 | 4 | 9 | 25 |
| 2-3 MB/PB | 3.05 | 2 | 4 | 6 | 25 |
| 2-4 MB | 4.57 | 4 | 4 | 8 | 26 |
| 2-4 MB/PB | 4.57 | 4 | 6 | 6 | 26 |

NOTE:
MB" = Matte Black Ink
"MB/PB" = Matte Black and Photo Black Inks

Example 3

The following example demonstrates the use of the monosaccharide, galactose or the disaccharide, lactose in the image-receiving layer. An under-layer was prepared as described in Example 1.

Preparation and Evaluation of Image-Receiving Layers

A coating solution for the ink-jet, image-receiving layer (Comparative Example 3-1) was prepared by mixing 42.72 g of DISPERAL® HP-14 (pH adjusted to 3.25 with 70% nitric acid) as a 20% aqueous solution, 7.43 g of CELVOL® 540 poly(vinyl alcohol) as a 10% aqueous solution, and 0.71 g of a Surfactant 10G as a 10% aqueous solution. The finished coating solution was at 18.0% solids. Inventive coating solutions, Examples 3-2, 3-3, 3-4 and 3-5 were also prepared as described above but 0.71 g or 1.03 g of a 20% aqueous solution of galactose, or 0.71 g or 1.03 g of a 20% aqueous solution of lactose were added, respectively. The finished coating solutions were at 18.3%, 18.4%, 18.3% or 18.4% solids, respectively. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The image-receiving layer was coated at 42.7 g/m$^2$ (using a 12.5 mil knife gap). In all, 5 samples were prepared.

Samples were imaged as described above for drying of ink or to determine the smudging of ink (first method). Table III shows the type of sugar added, the percent by weight of galactose or lactose added to the coating, the fraction of the patch having an optical density of 2.9 that was still wet 5 seconds after the completion of printing, and the smudging values with matte black or matte black and photo black after 6 hours and 24 hours after printing and haze.

The data demonstrates that the addition of 2.2 wt % of galactose to the ink-jet, image-receiving layer improved the time to dry the ink patch having an optical density of at least 2.8.

The data also demonstrates that the addition of at least 1.5 wt % of galactose or lactose to the image-receiving layer improved smudging after 24 hours from printing with the matte black or matte black and photo black inks.

TABLE III

| Sample # and Sugar and Ink(s) | Sugar (wt % of dry solids) | Percent of Patch Wet | Smudge Value at 6 hr | Smudge Value at 24 hr | Haze (%) |
|---|---|---|---|---|---|
| 3-1 No Sugar MB | 0 | 50 | 5 | 5 | 22 |
| 3-1 No Sugar MB/PB | 0 | 50 | 5 | 5 | 22 |
| 3-2 Galactose MB | 1.5 | 50 | 5 | 6 | 23 |
| 3-2 Galactose MB/PB | 1.5 | 50 | 5 | 6 | 23 |
| 3-3 Galactose MB | 2.2 | 25 | 5 | 6 | 23 |
| 3-3 Galactose MB/PB | 2.2 | 25 | 5 | 6 | 23 |
| 3-4 Lactose MB | 1.5 | 50 | 5 | 6 | 24 |
| 3-4 Lactose MB/PB | 1.5 | 50 | 5 | 6 | 24 |
| 3-5 Lactose MB | 2.2 | 50 | 5 | 7 | 24 |
| 3-5 Lactose MB/PB | 2.2 | 50 | 5 | 7 | 24 |

NOTE:
"MB" = Matte Black Ink
"MB/PB" = Matte Black and Photo Black Inks

Example 4

The following example demonstrates the use of the monosaccharide, fructose or the disaccharide, sucrose in the image-receiving layer. An under-layer was prepared as described in Example 1 except the dry coating weight was 0.89 g/m$^2$.

Preparation and Evaluation of Image-Receiving Layers

A coating solution for the ink-jet, image-receiving layer (Comparative Example 4-1) was prepared by mixing 42.72 g of DISPERAL® HP-14 (pH adjusted to 3.25 with 70% nitric acid) as a 20% aqueous solution, 7.43 g of CELVOL®540 poly(vinyl alcohol) as a 10% aqueous solution, and 0.71 g of a Surfactant 10G as a 10% aqueous solution. The finished coating solution was at 18.0% solids. Inventive coating solutions, Examples 4-2, 4-3, 4-4 and 4-5 were also prepared as described above but 0.71 g or 1.03 g of a 20% aqueous solution of fructose, or 0.71 g or 1.03 g of a 20% aqueous solution of sucrose were added, respectively. The finished coating solutions were at 18.3%, 18.4%, 18.3% or 18.4% solids, respectively. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The image-receiving layer was coated at 42.7 g/m$^2$ (using a 12.5 mil knife gap). In all, 5 samples were prepared.

Samples were imaged as described above for drying of ink or to determine the smudging of ink (first method). Table IV shows the type of sugar added, the percent by weight of fructose or sucrose added to the coating, the fraction of the patch having an optical density of 2.9 that was still wet 5 seconds after the completion of printing, and the smudging values with matte black or matte black and photo black after 6 hours and 24 hours after printing and haze.

The data demonstrates that the addition of at least 1.5 wt % of fructose or sucrose to the ink-jet, image-receiving layer improved the time to dry the ink patch having an optical density of at least 2.8.

The data also demonstrates that the addition of at least 2.2 wt % of fructose or 1.5% sucrose to the image-receiving layer improved smudging after 24 hours from printing with the matte black or matte black and photo black inks.

TABLE IV

| Sample # and Sugar and Ink(s) | Sugar (wt % of dry solids) | Percent of Patch Wet | Smudge Value at 6 hr | Smudge Value at 24 hr | Haze (%) |
|---|---|---|---|---|---|
| 4-1 No Sugar MB | 0 | 50 | 5 | 5 | 26 |
| 4-1 No Sugar MB/PB | 0 | 50 | 5 | 5 | 26 |
| 4-2 Fructose MB | 1.5 | 12.5 | 4 | 5 | 27 |
| 4-2 Fructose MB/PB | 1.5 | 12.5 | 4 | 5 | 27 |
| 4-3 Fructose MB | 2.2 | 12.5 | 4 | 6 | 26 |
| 4-3 Fructose MB/PB | 2.2 | 12.5 | 5 | 6 | 26 |
| 4-4 Sucrose MB | 1.5 | 12.5 | 5 | 6 | 27 |
| 4-4 Sucrose MB/PB | 1.5 | 12.5 | 5 | 6 | 27 |
| 4-5 Sucrose MB | 2.2 | NM | 5 | 6 | 28 |
| 4-5 Sucrose MB/PB | 2.2 | NM | 5 | 6 | 28 |

NOTE:
"MB" = Matte Black Ink
"MB/PB" = Matte Black and Photo Black Inks
"NM" = Not Measured

Example 5

The following example demonstrates the use of the monosaccharides, galactose or glucose or the disaccharide, lactose in the image-receiving layer. An under-layer was prepared as described in Example 4.

Preparation and Evaluation of Image-Receiving Layers

A coating solution for the ink-jet, image-receiving layer (Comparative Example 5-1) was prepared by mixing 41.00 g of DISPERAL® HP-14 (pH adjusted to 3.25 with 70% nitric acid) as a 20% aqueous solution, 7.10 g of CELVOL® 540 poly(vinyl alcohol) as a 10% aqueous solution, and 0.66 g of a Surfactant 10G as a 10% aqueous solution. The finished coating solution was at 18.0% solids. Inventive coating solutions, Examples 5-2, 5-3, 5-4, 5-5, 5-6 and 5-7 were also prepared as described above but 0.68 g or 1.00 g of a 20% aqueous solution of galactose or 0.71 g or 1.03 g of a 20% aqueous solution of glucose or 0.71 g or 1.03 g of a 20% aqueous solution of lactose were added, respectively. The finished coating solutions were at 18.3%, 18.4%, 18.3%, 18.4%, 18.3% or 18.4% solids, respectively. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The image-receiving layer was coated at 41 g/m$^2$ (using a 12.0 mil knife gap). In all, 7 samples were prepared.

Samples were imaged as described above for drying of ink or to determine the smudging of ink (first method). Table V shows the type of sugar added, the percent by weight of galactose, glucose or lactose added to the coating, the fraction of the patch having an optical density of 2.9 that was still wet 5 seconds after the completion of printing, and the smudging values with matte black after 6 hours and 24 hours after printing and haze.

The data demonstrates that the addition of at least 1.5 wt % of galactose, glucose or lactose to the ink-jet, image-receiving layer improved the time to dry the ink patch having an optical density of at least 2.8.

The data also demonstrates that the addition of at least 2.2 wt % of galactose or lactose to the image-receiving layer improved smudging after 6 hours or 2.2% glucose to the image-receiving layer improved smudging after 24 hours from printing with the matte black inks.

TABLE V

| Sample # and Sugar and Ink(s) | Sugar (wt % of dry solids) | Percent of Patch Wet | Smudge Value at 6 hr | Smudge Value at 24 hr | Haze (%) |
|---|---|---|---|---|---|
| 5-1 No Sugar MB | 0 | 50 | 4 | 5 | 24 |
| 5-2 Galactose MB | 1.5 | 25 | 4 | 5 | 23 |
| 5-3 Galactose MB | 2.2 | 12.5 | 5 | 7 | 24 |
| 5-4 Glucose MB | 1.5 | 25 | 3 | 4 | 24 |
| 5-5 Glucose MB | 2.2 | 0 | 3 | 6 | 25 |
| 5-6 Lactose MB | 1.5 | 25 | 4 | 6 | 24 |
| 5-7 Lactose MB | 2.2 | 25 | 5 | 6 | 26 |

NOTE:
"MB" = Matte Black Ink

Example 6

The following example demonstrates the use of the monosaccharide fructose or the disaccharide, sucrose in the image-receiving layer. An under-layer was prepared as described in Example 4.

Preparation and Evaluation of Image-Receiving Layers

A coating solution for the ink-jet, image-receiving layer (Comparative Example 6-1) was prepared by mixing 41.00 g of DISPERAL® HP-14 (pH adjusted to 3.25 with 70% nitric acid) as a 20% aqueous solution, 7.10 g of CELVOL® 540 poly(vinyl alcohol) as a 10% aqueous solution, and 0.66 g of a Surfactant 10G as a 10% aqueous solution. The finished coating solution was at 18.0% solids. Inventive coating solutions, Examples 6-2 and 6-3 were also prepared as described above but 0.68 g of a 20% aqueous solution of fructose or 1.03 g of a 20% aqueous solution of sucrose were added, respectively. The finished coating solutions were at 18.3% or 18.4% solids, respectively. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The image-receiving layer was coated at 41 g/m$^2$ (using a 12.0 mil knife gap). In all, 3 samples were prepared.

Samples were imaged as described above to determine the smudging of ink (first method). Table VI shows the type of sugar added, the percent by weight of fructose or sucrose added to the coating, and the smudging values with matte black after 6 hours and 24 hours after printing and haze.

The data also demonstrates that the addition of at least 1.5 wt % of fructose or 2.2% sucrose to the image-receiving layer improved smudging after 6 hours from printing with the matte black inks or the matte black and photo black inks.

TABLE VI

| Sample # and Sugar and Ink(s) | Sugar (wt % of dry solids) | Smudge Value at 6 hr | Smudge Value at 24 hr | Haze (%) |
|---|---|---|---|---|
| 6-1 No Sugar MB | 0 | 3 | 5 | 22 |
| 6-1 No Sugar MB/PB | 0 | 6 | 9 | 22 |
| 6-2 Fructose MB | 1.5 | 4 | 6 | 23 |
| 6-2 Fructose MB/PB | 1.5 | 6 | 10 | 23 |
| 6-3 Sucrose MB/PB | 2.2 | 4 | 7 | 25 |
| 6-3 Sucrose MB/PB | 2.2 | 7 | 10 | 25 |

NOTE:
"MB" = Matte Black Ink
"MB/PB" = Matte Black and Photo Black Inks

Example 7

The procedure of Example 2 was repeated, using 1.06 g of a 40% aqueous solution of sucrose, but omitting Surfactant 10G from the image-receiving layer. A comparative example was run using the same level of sucrose, also omitting Surfactant 10G from the image-receiving layer. The results are shown in Table VII. Addition of sucrose improved smudging performance, even with no surfactant being present.

Even more, by comparing the results of Example 7-2 in Table VII to those of Example 2-4 in Table II, it is apparent that the smudging performance at 24 hours without any surfactant present was better than that when using a surfactant. This suggests that the sucrose, and not the surfactant, was responsible for the improved smudging behavior.

TABLE VII

| Sample # and Ink(s) | Sucrose (wt % of dry solids) | Smudge Value at 30 sec | Smudge Value at 6 hr | Smudge Value at 24 hr | Haze (%) |
|---|---|---|---|---|---|
| 7-1 MB | 0 | 2 | 2 | 4 | 18 |
| 7-1 MB/PB | 0 | 2 | 2 | 2 | 18 |

TABLE VII-continued

| Sample # and Ink(s) | Sucrose (wt % of dry solids) | Smudge Value at 30 sec | Smudge Value at 6 hr | Smudge Value at 24 hr | Haze (%) |
|---|---|---|---|---|---|
| 7-2 MB | 4.57 | 3 | 4 | 9 | 22 |
| 7-2 MB/PB | 4.57 | 3 | 6 | 7 | 22 |

NOTE:
"MB" = Matte Black Ink
"MB/PB" = Matte Black and Photo Black Inks

Example 8

The following example demonstrates the use of sucrose with varying levels of surfactant in the image-receiving layer, in a transparent film comprising a gelatin-borax under-layer.

Preparation of Under-Layers

A coating solution was prepared by slowly adding 18.00 parts of gelatin to 239.64 parts of deionized water while stirring at room temperature. After 15 min, the agitated mixture was heated to 60° C. To this mixture was added 8.10 parts sodium tetraborate decahydrate, after which the mixture continued to be agitated for 15 min. To this mixture, 28.13 parts of an aqueous solution of 3.2 wt % sulfonated polystyrene (VERSA-TL® 205, AkzoNobel) and 0.2 wt % microbiocide (KATHON® LX, Dow) was added and mixed for 15 min. To this mixture, 6.14 parts of a 10 wt % aqueous solution of nonyl phenol, glycidyl polyether (Surfactant 10G) was then added and mixed for 5 min. The ratio of borax to gelatin in the mix was 0.45:1 by weight. The coating solution was knife coated at room temperature onto seven 7 mil (178 micron) polyethylene terephthalate supports. The coatings were air dried. The dry coating weight of each under-layer was 4.3 g/m$^2$.

Preparation of Image-Receiving Layer Coating Mix (Samples 8-1 and 8-2)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, and 1.66 g of deionized water. The finished coating solution was at 17.9% solids. The weight ratio of inorganic particles to polymer was 92:8.

Preparation of Image-Receiving Layer Coating Mix (Sample 8-3)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 0.91 g deionized water, and 0.75 g of a 20% aqueous solution of sucrose. The finished coating solution was 18.2% solids. The weight ratio of inorganic particles to polymer was 92:8.

Preparation of Image-Receiving Layer Coating Mix (Sample 8-4)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 0.66 g deionized water, and 1.00 g of a 20% aqueous solution of sucrose. The finished coating solution was 18.3% solids. The weight ratio of inorganic particles to polymer was 92:8.

Preparation of Image-Receiving Layer Coating Mix (Sample 8-5)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 1.00 g deionized water, and 0.66 g of Surfactant 10G as a 10% aqueous solution. The finished coating solution was 18.0% solids. The weight ratio of inorganic particles to polymer was 92:8.

Preparation of Image-Receiving Layer Coating Mix (Sample 8-6)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 0.25 g deionized water, 0.75 g of a 20% aqueous solution of sucrose, and 0.66 g of Surfactant 10G as a 10% aqueous solution. The finished coating solution was 18.3% solids. The weight ratio of inorganic particles to polymer was 92:8.

Preparation of Image-Receiving Layer Coating Mix (Sample 8-7)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 1.00 g of a 20% aqueous solution of sucrose, and 0.66 g of Surfactant 10G as a 10% aqueous solution. The finished coating solution was 18.4% solids. The weight ratio of inorganic particles to polymer was 92:8.

Preparation and Evaluation of Image-Receiving Layer Coatings

The image-receiving layer coating mixes were knife coated at room temperature onto the under-layers prepared above. Each solution was coated onto each of the under-layers. All coatings were dried in a forced air oven at 85° C. for 10 minutes. No mud-cracking was observed on the dried coatings. Each of the image-receiving layers was coated at 44.3 g/m$^2$. In all, seven samples were prepared.

Samples were imaged as described above to determine the smudging of ink (second method). The results are shown in Table VIII. Smudging performance of coated films having sucrose, but no surfactant, in their image-receiving layers was superior to those films either having no sucrose or having both sucrose and surfactant in their image-receiving layers.

TABLE VIII

| Sample # | Sucrose (wt % of dry solids) | Surfactant (wt % of dry solids) | % Loss of Optical Density Due to Smudging | | | | |
|---|---|---|---|---|---|---|---|
| | | | Step 10 | Step 11 | Step 12 | Step 13 | Step 14 |
| 8-1 | 0 | 0 | 7.9 | 6.6 | 12.1 | 19.1 | 31.3 |
| 8-2 | 0 | 0 | 5.7 | 3.9 | 9.6 | 16.0 | 30.3 |
| 8-3 | 1.70 | 0 | 5.1 | 3.8 | 5.7 | 15.5 | 20.8 |
| 8-4 | 2.20 | 0 | 2.6 | 3.8 | 4.5 | 12.0 | 21.8 |
| 8-5 | 0 | 0.79 | 6.2 | 5.4 | 11.9 | 13.0 | 27.6 |
| 8-6 | 1.70 | 0.79 | 4.7 | 5.3 | 6.9 | 16.2 | 29.4 |
| 8-7 | 2.20 | 0.79 | 6.4 | 10.3 | 11.0 | 20.1 | 31.9 |

Example 9

The following example demonstrates the use of sucrose with no surfactant in the image-receiving layer, in a transparent film comprising a gelatin-borax under-layer.

Preparation and Evaluation of Under-Layers

Three under-layer coated supports were prepared according to the procedure of Example 8.

Preparation of Image-Receiving Layer Coating Mix (Sample 9-1)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL° 540 poly(vinyl alcohol) as a 10% aqueous solution, and 1.66 g of deionized water. The finished coating solution was at 17.9% solids. The weight ratio of inorganic particles to polymer was 92:8.

Preparation of Image-Receiving Layer Coating Mix (Sample 9-2)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 1.16 g of deionized water, and 0.50 g of a 40% aqueous solution of sucrose. The finished coating solution was at 18.3% solids. The weight ratio of inorganic particles to polymer was 92:8.

Preparation of Image-Receiving Layer Coating Mix (Sample 9-3)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 0.66 g of deionized water, and 1.00 g of a 40% aqueous solution of sucrose. The finished coating solution was at 18.7% solids. The weight ratio of inorganic particles to polymer was 92:8.

Preparation and Evaluation of Image-Receiving Layer Coatings

The image-receiving layer coating mixes were knife coated at room temperature onto the under-layers prepared above. Each solution was coated onto each of the under-layers. All coatings were dried in a forced air oven at 85° C. for 10 minutes. No mud-cracking was observed on the dried coatings. Each of the image-receiving layers was coated at 44.3 g/m$^2$. In all, three samples were prepared.

Samples were imaged as described above to determine the smudging of ink (second method). The results are shown in Table IX. Smudging performance of coated films having 2.20% sucrose in their image-receiving layers was superior to those films either having no sucrose or having 4.30% sucrose in their image-receiving layers.

TABLE IX

| Sample # | Sucrose (wt % of dry solids) | Surfactant (wt % of dry solids) | % Loss of Optical Density Due to Smudging | | | | |
|---|---|---|---|---|---|---|---|
| | | | Step 10 | Step 11 | Step 12 | Step 13 | Step 14 |
| 9-1 | 0 | 0 | 8.7 | 11.2 | 15.5 | 28.4 | 35.9 |
| 9-2 | 2.20 | 0 | 4.8 | 8.1 | 10.2 | 17.3 | 27.1 |
| 9-3 | 4.30 | 0 | 10.1 | 12.7 | 21.6 | 27.0 | 37.7 |

Example 10

The following example demonstrates the use of lactose with varying levels of surfactant in the image-receiving layer, in a transparent film comprising a gelatin-borax under-layer.

Preparation and Evaluation of Under-Layers

Seven under-layer coated supports were prepared according to the procedure of Example 8.

Preparation of Image-Receiving layer Coating Mix (Samples 10-1 and 10-2)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, and 1.66 g of deionized water. The finished coating solution was at 17.9% solids. The weight ratio of inorganic particles to polymer was 92:8.

Preparation of Image-Receiving Layer Coating Mix (Sample 10-3)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 0.91 g of deionized water, and 0.75 g of a 20% aqueous solution of lactose. The finished coating solution was at 18.2% solids. The weight ratio of inorganic particles to polymer was 92:8.

Preparation of Image-Receiving Layer Coating Mix (Sample 10-4)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 0.66 g of deionized water, and 1.00 g of a 20% aqueous solution of lactose. The finished coating solution was at 18.3% solids. The weight ratio of inorganic particles to polymer was 92:8.

Preparation of Image-Receiving Layer Coating Mix (Sample 10-5)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 1.00 g of deionized water, and 0.66 g of Surfactant 10G as a 10% aqueous solution. The finished coating solution was at 18.0% solids. The weight ratio of inorganic particles to polymer was 92:8.

Preparation of Image-Receiving Layer Coating Mix (Sample 10-6)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 0.25 g of deionized water, 0.66 g of Surfactant 10G as a 10% aqueous solution, and 0.75 g of a 20% aqueous solution of lactose. The finished coating solution was at 18.3% solids. The weight ratio of inorganic particles to polymer was 92:8.

Preparation of Image-Receiving Layer Coating Mix (Sample 10-7)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 0.66 g of Surfactant 10G as a 10% aqueous solution, and 1.00 g of a 20% aqueous solution of lactose. The finished coating solution was at 18.4% solids. The weight ratio of inorganic particles to polymer was 92:8.

Preparation and Evaluation of Image-Receiving Layer Coatings

The image-receiving layer coating mixes were knife coated at room temperature onto the under-layers prepared above. Each solution was coated onto each of the under-layers. All coatings were dried in a forced air oven at 85° C. for 10 minutes. No mud-cracking was observed on the dried coatings. Each of the image-receiving layers was coated at 44.3 g/m$^2$. In all, seven samples were prepared.

Samples were imaged as described above to determine the smudging of ink (second method). The results are shown in Table X. At high optical densities, for films with image-receiving layers having no surfactant, increasing lactose improved smudging performance. However, films with image receiving layers having both surfactant and lactose exhibited poorer smudging performance than films with image-receiving layers having surfactant alone.

TABLE X

| Sample # | Lactose (wt % of dry solids) | Surfactant (wt % of dry solids) | % Loss of Optical Density Due to Smudging | | | | |
|---|---|---|---|---|---|---|---|
| | | | Step 10 | Step 11 | Step 12 | Step 13 | Step 14 |
| 10-1 | 0 | 0 | 6.1 | 11.5 | 14.1 | 23.4 | 37.3 |
| 10-2 | 0 | 0 | 8.3 | 11.2 | 16.8 | 23.8 | 39.3 |
| 10-3 | 1.70 | 0 | 9.3 | 8.1 | 17.2 | 26.4 | 35.6 |
| 10-4 | 2.20 | 0 | 7.6 | 11.2 | 14.3 | 23.0 | 35.4 |
| 10-5 | 0 | 0.79 | 2.5 | 5.2 | 8.8 | 14.4 | 28.0 |
| 10-6 | 1.70 | 0.79 | 6.6 | 7.8 | 13.4 | 25.7 | 30.7 |
| 10-7 | 2.20 | 0.79 | 8.1 | 8.1 | 17.4 | 20.5 | 27.3 |

Example 11

The following example demonstrates the use of galactose with varying levels of surfactant in the image-receiving layer, in a transparent film comprising a gelatin-borax under-layer.

Preparation and Evaluation of Under-Layers

Seven under-layer coated supports were prepared according to the procedure of Example 8.

Preparation of Image-Receiving Layer Coating Mix (Samples 11-1 and 11-2)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, and 1.66 g of deionized water. The finished coating solution was at 17.9% solids. The weight ratio of inorganic particles to polymer was 92:8.

Preparation of lineage-Receiving Layer Coating Mix (Sample 11-3)

A coating solution for the ink-jet, image-receiving layer was prepared by mixing 41.0 g of DISPERAL° HP-14 (pH adjusted to 3.25 with 70% nitric acid) as a 20% aqueous solution, 7.13 g of CELVOL® 540 poly(vinyl alcohol) as a 10% aqueous solution, 0.91 g of deionized water, and 0.75 g of a 20% aqueous solution of galactose. The finished coating solution was at 18.2% solids. The weight ratio of inorganic particles to polymer was 92:8.

Preparation of Image-Receiving Layer Coating Mix (Sample 11-4)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 0.66 g of deionized water, and 1.00 g of a 20% aqueous solution of galactose. The finished coating solution was at 18.3% solids. The weight ratio of inorganic particles to polymer was 92:8.

Preparation of Image-Receiving Layer Coating Mix (Sample 11-5)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 1.00 g of deionized water, and 0.66 g of Surfactant 10G as a 10% aqueous solution. The finished coating solution was at 18.0% solids. The weight ratio of inorganic particles to polymer was 92:8.

Preparation of Image-Receiving Layer Coating Mix (Sample 11-6)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 0.25 g of deionized water, 0.66 g of Surfactant 10G as a 10% aqueous solution, and 0.75 g of a 20% aqueous solution of galactose. The finished coating solution was at 18.3% solids. The weight ratio of inorganic particles to polymer was 92:8.

Preparation of Image-Receiving Layer Coating Mix (Sample 11-7)

A coating solution for the ink-jet, image-receiving layer was prepared by mixing 41.0 g of DISPERAL® HP-14 (pH adjusted to 3.25 with 70% nitric acid) as a 20% aqueous solution, 7.13 g of CELVOL® 540 poly(vinyl alcohol) as a 10% aqueous solution, 0.66 g of Surfactant 10G as a 10% aqueous solution, and 1.00 g of a 20% aqueous solution of galactose. The finished coating solution was at 18.4% solids. The weight ratio of inorganic particles to polymer was 92:8.

Preparation and Evaluation of Image-Receiving Layer Coatings

The image-receiving layer coating mixes were knife coated at room temperature onto the under-layers prepared above. Each solution was coated onto each of the under-layers. All coatings were dried in a forced air oven at 85° C. for 10 minutes. No mud-cracking was observed on the dried coatings. Each of the image-receiving layers was coated at 44.3 g/m$^2$. In all, seven samples were prepared.

Samples were imaged as described above to determine the smudging of ink (second method). The results are shown in Table XI. Smudging performance of films having galactose and no surfactant in their image-receiving layers was superior to that for films with both galactose and surfactant in their image-receiving layers. Smudging performance of coated films having 1.70% galactose in their image-receiving layers was superior to those films either having no galactose or having 2.20% galactose in their image-receiving layers.

TABLE XI

| Sample # | Galactose (wt % of dry solids) | Surfactant (wt % of dry solids) | % Loss of Optical Density Due to Smudging | | | | |
|---|---|---|---|---|---|---|---|
| | | | Step 10 | Step 11 | Step 12 | Step 13 | Step 14 |
| 11-1 | 0 | 0 | 8.1 | 6.4 | 12.9 | 18.8 | 28.3 |
| 11-2 | 0 | 0 | 4.8 | 6.8 | 8.0 | 16.3 | 27.6 |
| 11-3 | 1.70 | 0 | 2.6 | 4.6 | 4.0 | 10.2 | 21.1 |
| 11-4 | 2.20 | 0 | 6.8 | 6.1 | 11.1 | 16.0 | 25.0 |

TABLE XI-continued

| Sample # | Galactose (wt % of dry solids) | Surfactant (wt % of dry solids) | % Loss of Optical Density Due to Smudging | | | | |
|---|---|---|---|---|---|---|---|
| | | | Step 10 | Step 11 | Step 12 | Step 13 | Step 14 |
| 11-5 | 0 | 0.79 | 7.2 | 7.1 | 14.3 | 17.0 | 30.0 |
| 11-6 | 1.70 | 0.79 | 3.4 | 3.8 | 6.0 | 10.3 | 25.9 |
| 11-7 | 2.20 | 0.79 | 5.7 | 6.9 | 11.4 | 18.0 | 30.4 |

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A transparent ink-jet recording film comprising:

a transparent support;

at least one under-layer comprising at least one first polymer comprising gelatin and at least one borate or borate derivative; and at least one image-receiving layer disposed on the at least one under-layer, said at least one image-receiving layer comprising at least one second polymer and at least one inorganic particle, said at least one second polymer comprising at least one water soluble or water dispersible cross-linkable polymer comprising at least one hydroxyl group, wherein at least one of the at least one image-receiving layer further comprises sucrose in an amount of at least about 1.7 wt % and less than 4.3 wt %.

2. The transparent ink-jet recording film according to claim 1, wherein the at least one inorganic particle comprises alumina.

3. The transparent ink-jet recording film according to claim 1, wherein the at least one image-receiving layer comprises less than about 2.2 wt % of sucrose and further comprises nonyl phenol, glycidyl polyether.

4. A transparent ink-jet recording film comprising:

a transparent support;

at least one under-layer comprising at least one first polymer comprising gelatin and at least one borate or borate derivative; and at least one image-receiving layer disposed on the at least one under-layer, said at least one image-receiving layer comprising at least one second polymer and at least one inorganic particle, said at least one second polymer comprising at least one water soluble or water dispersible cross-linkable polymer comprising at least one hydroxyl group, wherein at least one of the at least one image-receiving layer further comprises galactose in an amount of at least about 1.7 wt % and less than 2.2 wt %.

5. The transparent ink-jet recording film according to claim 4, wherein the at least one inorganic particle comprises alumina.

6. The transparent ink-jet recording film according to claim 1, wherein the at least one second polymer comprises poly (vinyl alcohol).

7. The transparent ink-jet recording film according to claim 4, wherein the at least one second polymer comprises poly (vinyl alcohol).

* * * * *